US005318319A

United States Patent [19]

Jones et al.

[11] Patent Number: 5,318,319

[45] Date of Patent: Jun. 7, 1994

[54] ELECTRONIC CRICKET DART GAME

[75] Inventors: Richard F. Jones, Rockford; George H. Dell, Northfield, both of Ill.

[73] Assignee: Arachnid, Inc., Rockford, Ill.

[21] Appl. No.: 9,232

[22] Filed: Jan. 26, 1993

[51] Int. Cl.[5] ..... F41J 3/02

[52] U.S. Cl. ..... 273/371

[58] Field of Search ..... 273/371, 407, 408

[56] References Cited

U.S. PATENT DOCUMENTS

| | | | |
|---|---|---|---|
| 4,057,251 | 11/1977 | Jones | 273/408 X |
| 4,415,162 | 11/1983 | Sheppard | 273/371 |
| 4,948,148 | 8/1990 | Danielson | 273/468 |
| 4,974,857 | 12/1990 | Beall et al. | 273/371 |

FOREIGN PATENT DOCUMENTS

| | | | |
|---|---|---|---|
| 2130107 | 5/1984 | United Kingdom | 273/371 |

*Primary Examiner*—William H. Grieb

*Attorney, Agent, or Firm*—McAndrews, Held & Malloy, Ltd.

[57] ABSTRACT

A battery powered electronic dart game that is capable of scoring the game of Cricket uses multicolored or flashing lamps to indicate a current mark score. In one embodiment, the multi-colored lamps may be bi-color LED's that indicate four states with regard to marks scored in a particular dart bed. In another embodiment, the flashing lamps may be LED's flashed at different rates to indicate the four states with regard to marks scored in a particular dart bed. In a third embodiment, the lamps may be both colored and flashed to indicate marks scored. A score panel may be connected to a dart board, together containing processing and display driver circuitry for indicating a current score on the lamps and on numerical displays. Alternatively, the display panel may be a separate unit and may completely house the processing and display driver circuitry, thereby providing portability.

16 Claims, 8 Drawing Sheets

201
MC68HC05C8P
U1
RES
Vpp
PD7
OS1
OS2
TCMP
TCAP
PD0
PD1
PD2
PD5
PD4
PD3
PA0
PA1
PA2
PA3
IRQ
PA7
PA6
PA5
PA4
PC0
PC1
PC2
PC3
PC4
PC5
PC6
PC7
PB0
PB1
PB2
PB3
PB4
PB5
PB6
PB7
5V
R5 3.3K
CLK
DATA
ENA
EMB
R1 3.3K
R2 3.3K
R3 3.3K
R4 3.3K
SW1
SW2
OPTION
SELECT
203
16x4 SWITCH MATRIX
P1

ELECTRONIC CRICKET DART GAME

TECHNICAL FIELD

The present invention relates to an electronic dart game, and more particularly to a battery powered electronic dart game capable of scoring a game of Cricket using multi-colored and/or flashing lamps to indicate a current score.

BACKGROUND OF THE INVENTION

The dart game of Cricket is known and has generally accepted rules for determining a winning player. Cricket requires each player to score three dart landings or "marks" in each of the dart board beds numbered 15–20 and in the bullseye bed. When a player scores three marks in a particular bed, that player is said to have "closed" that bed. If one player successfully closes a bed before the other player closes the same bed, each successive mark scored in that bed by the first player is added to that player's numerical total score. The first player may therefore continue to land darts in that bed and increase his total score until the second player is able to close the bed. The end of the game of Cricket occurs when a player has closed all of the dart board beds 15–20 and bullseye, and achieved a higher numerical score than his opponent(s). The first player to accomplish this is the winner.

In another version of the game of Cricket, the players are required to close each of the dart board beds numbered 15–20 and the bullseye bed. No numerical score is kept. The winner of this version of Cricket is the player who first successfully closes all the beds.

Traditionally, Cricket game scores are kept by "chalking" wherein the marks and numerical scores are recorded by simply writing with chalk on a chalk board. This method suffered from the shortcoming of being messy, often producing illegible scores. Thus, chalked scores are generally difficult to read at a distance. This is particularly true in smoky, dark bar or tavern environments where a great number of dart games are played. Furthermore, "chalking" requires the players to constantly erase and revise the numerical scores, subjecting the scores to possible human arithmetical errors.

Prior art devices have attempted to overcome the shortcomings of the "chalking" method for scoring a game of Cricket. For example, one known device uses, for each player, a string of 3 LED's associated with each of the dart beds 15–20 and the bullseye bed to indicate the number of marks made in each bed. However, in order to score Cricket, such a device requires significant circuitry to accommodate 42 LED's as well as numerous LED drivers. This circuitry increases the manufacturing cost of the device, requires high current to run, and results in a larger device not suitable for portable or hand-held use. Additionally, the strings of 3 LED's tend to blur at a distance making it difficult to determine the number of marks scored.

SUMMARY OF THE INVENTION

In accordance with the present invention, the disadvantages found in the displays of electronic Cricket dart games, as discussed above, have been overcome. More particularly, an electronic dart game is disclosed which is capable of scoring dart impacts in a game of Cricket. The electronic dart game provides an indication when a dart impact occurs in a dart bed of a dart board. Responding to the indication of an impact, a current score is computed by control circuitry, and then the control circuitry produces drive signals which are indicative of the current score. Responding to these drive signals, a lamp produces one of a plurality of colors of light indicative of the current score. Alternately, the lamp of the present invention may be responsive to the drive signals for producing flashing light so as to indicate the current score. Similarly, the lamp can respond by both flashing and producing colors.

These and other objects and advantages of the invention, as well as details of an illustrative embodiment, will be more fully understood from the following description and the drawings.

DESCRIPTION OF THE PREFERRED EMBODIMENT

Figure 1:
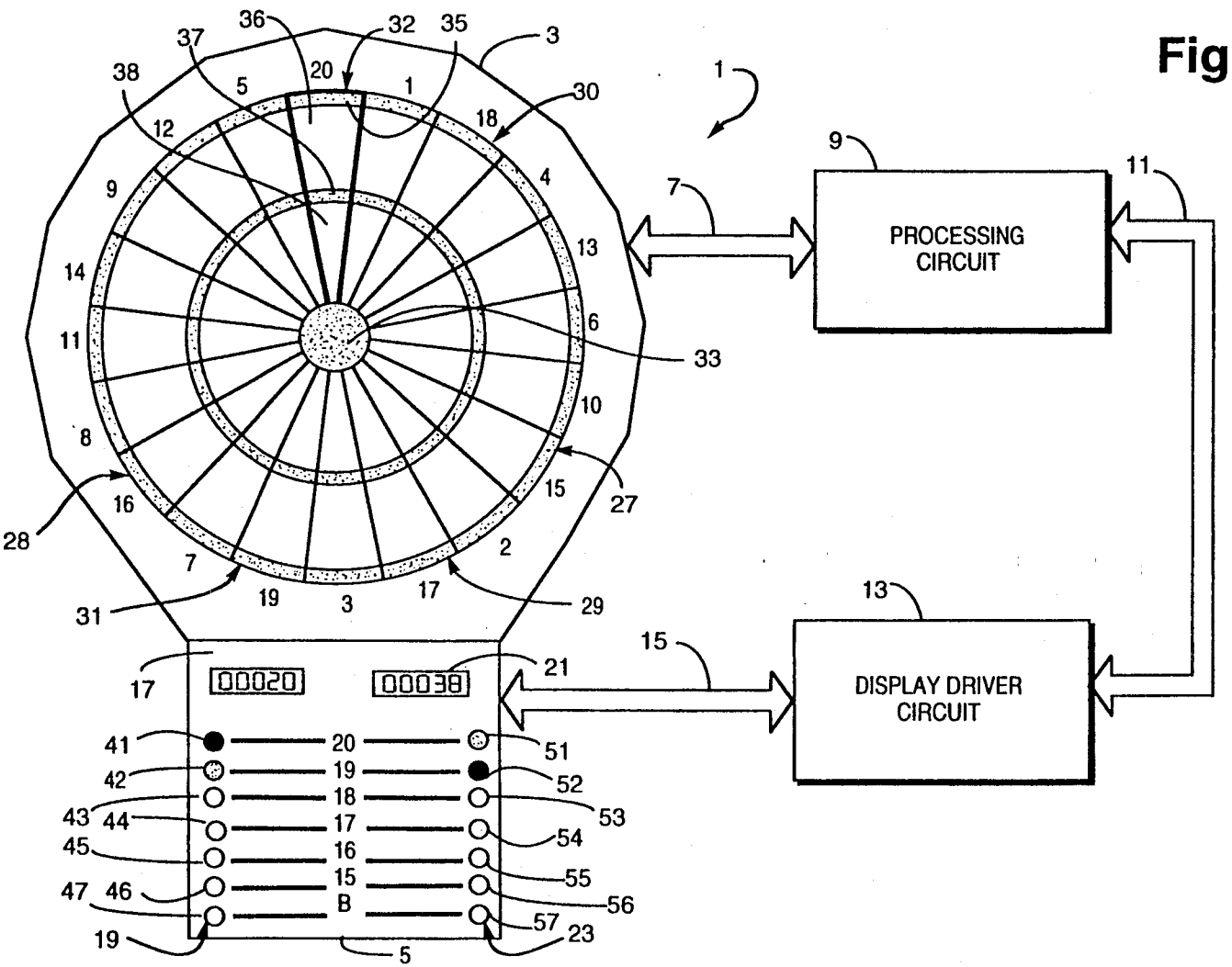
FIG. 1 is a block diagram of the electronic cricket dart game of the present invention.

FIG. 1 illustrates an electronic Cricket dart game 1 of the present invention which automatically scores the game of Cricket. Darts are thrown at a dart board 3, and, in response to dart impacts, the current score is calculated and displayed on a score panel 5. More specifically, dart impacts on the dart board 3 are reflected in signals on a sensing bus 7. A processing circuit 9 monitors the sensing bus 7 to identify such dart impacts. Upon detecting an impact, the processing circuit 9 responds by calculating a current score, and generating control signals indicative of the current score on a control bus 11. Responding to the signals on the control bus 11, a display driver circuit 13 produces drive signals on a drive bus 15 causing the current score to be displayed on the score panel 5.

Together, the processing circuit 9 and display driver circuit 13 control the operation of the electronic Cricket dart game 1. Although shown externally for illustrative purposes, the processing circuit 9, display driver 13 and associated busses are located within the score panel 5 and dart board 3.

To show the current score, two sets of displays are required for each player. The score panel 5 contains a numerical display 17 and an array of lamps 19 for a first player, and, for a second player, a corresponding numerical display 21 and array of lamps 23. The numerical displays 17 and 21 display the players' current numerical score, while the arrays of lamps 19 and 23 indicate the current mark score. The latter indication in a first embodiment of the invention is accomplished using multi-colored light. In a second embodiment, the indication is accomplished using flashing light. A combination of multi-colored and flashing light is utilized in a further embodiment.

Specifically, the dart board 3 includes Cricket dart beds 27–33 associated with dart board numbers 15–20 and a bullseye, respectively. Each of dart beds 27–32 consists of four segments, for example, segments 35–38 associated with the dart board number 20. If, for example, a dart impacts the segment 36 or 38, a "single" 20 is marked. Similarly, a dart impacting the dart segment 35 constitutes a "double" mark score, while a dart impacting the dart segment 37 constitutes a "triple" mark score.

The processing circuit 9 detects dart impacts on the segments of the dart beds 27–33 by monitoring the dart board 3. More specifically, the processing circuit 9 scans via the sensing bus 7 a set of switches (not shown) associated with each segment on the dart board 3. When a dart impacts a segment, the segment moves inward to actuate associated switches. By scanning the sensing bus 7, the processing circuit 9 detects such actuation. An example of the interaction between the segments and associated switches is disclosed in greater detail in U.S. Pat. No. 4,057,251 issued to Jones et al. incorporated herein by reference. Although moveable segments associated with switches is preferred, magnetic or other types of sensing of dart impacts may also be used. Similarly, hard-wired logic in place of scanning circuitry within the processing circuit 9 may also be used to monitor the sensing bus 7.

Once the processing circuit 9 identifies a dart impact, it calculates the current score and, if the previous score needs to be updated, produces a control signal on the control bus 11 indicative of the current score.

Once the processing circuit 9 determines that an appropriate mark or impact has occurred, it causes via control bus 11 the display driver circuit 13 to activate appropriate mark indicator lamps 41–47 (together the array of lamps 19) and 51–57 (together the array of lamps 23) corresponding to players one and two respectively. The mark indicator lamps 41–47 and 51–57 display the current mark score corresponding to the dart board numbers 15–20 and the bullseye as shown on the score panel 5, respectively. While LED's (light emitting diodes) are preferred for their low power characteristics, other types of mark indicator lamps are contemplated and can also be used.

Figure 3A:
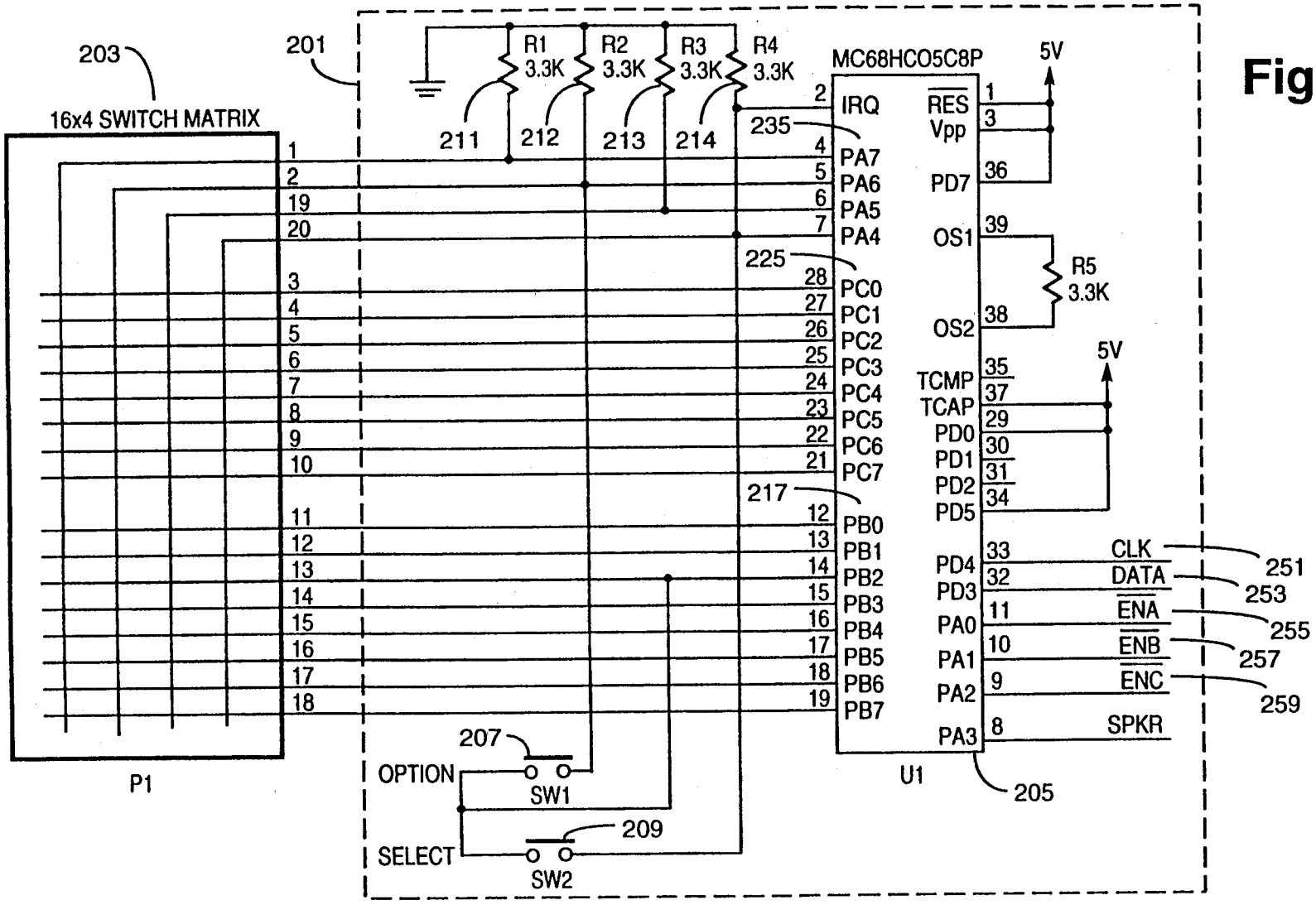
FIG. 3A, 3B, and 3C together (collectively referred to herein as FIG. 3) are a circuit diagram illustrating an embodiment of the present invention wherein multicolor LED's are used to indicate a current score.
Figure 3B:
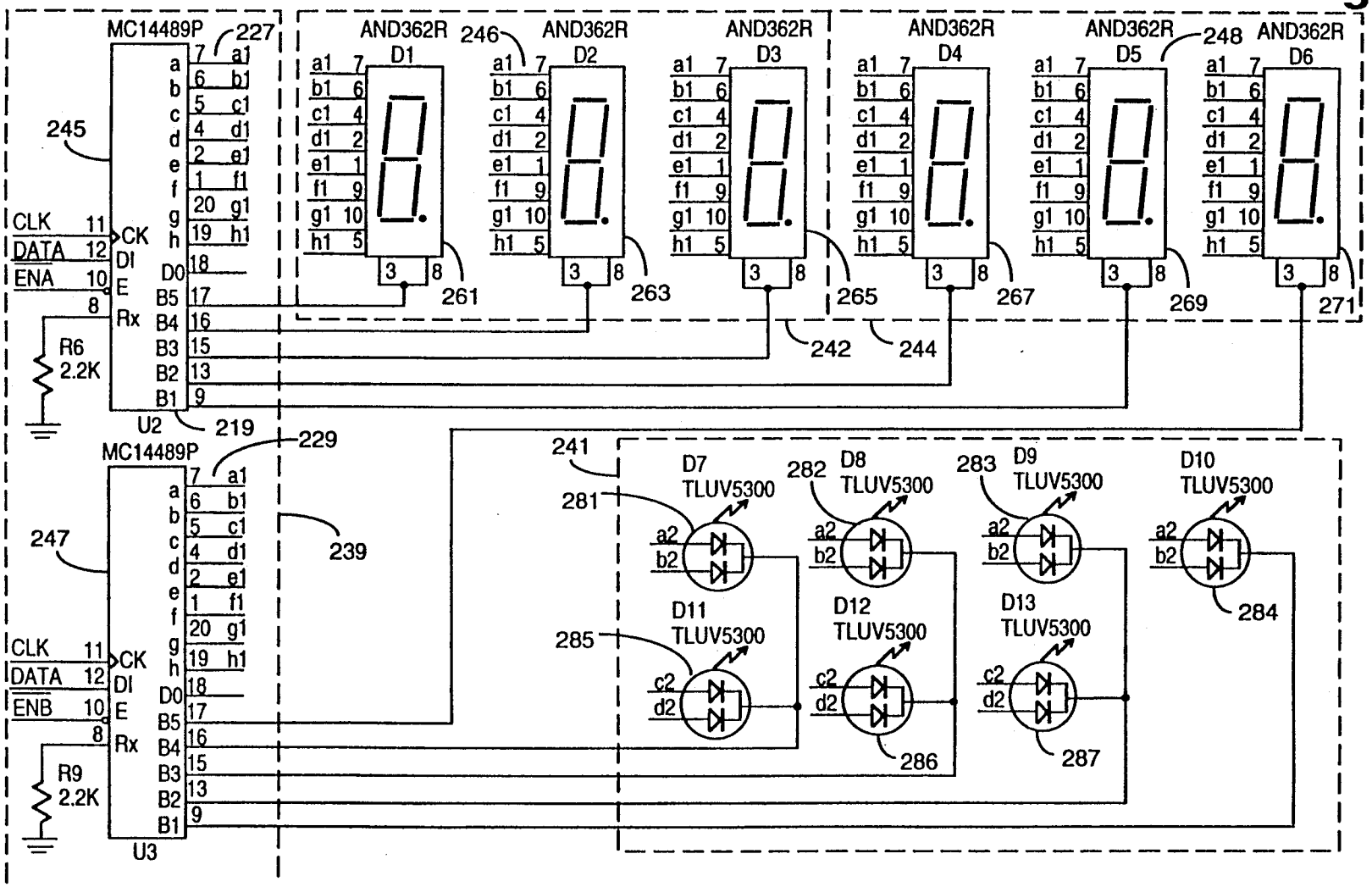
Figure 3C:
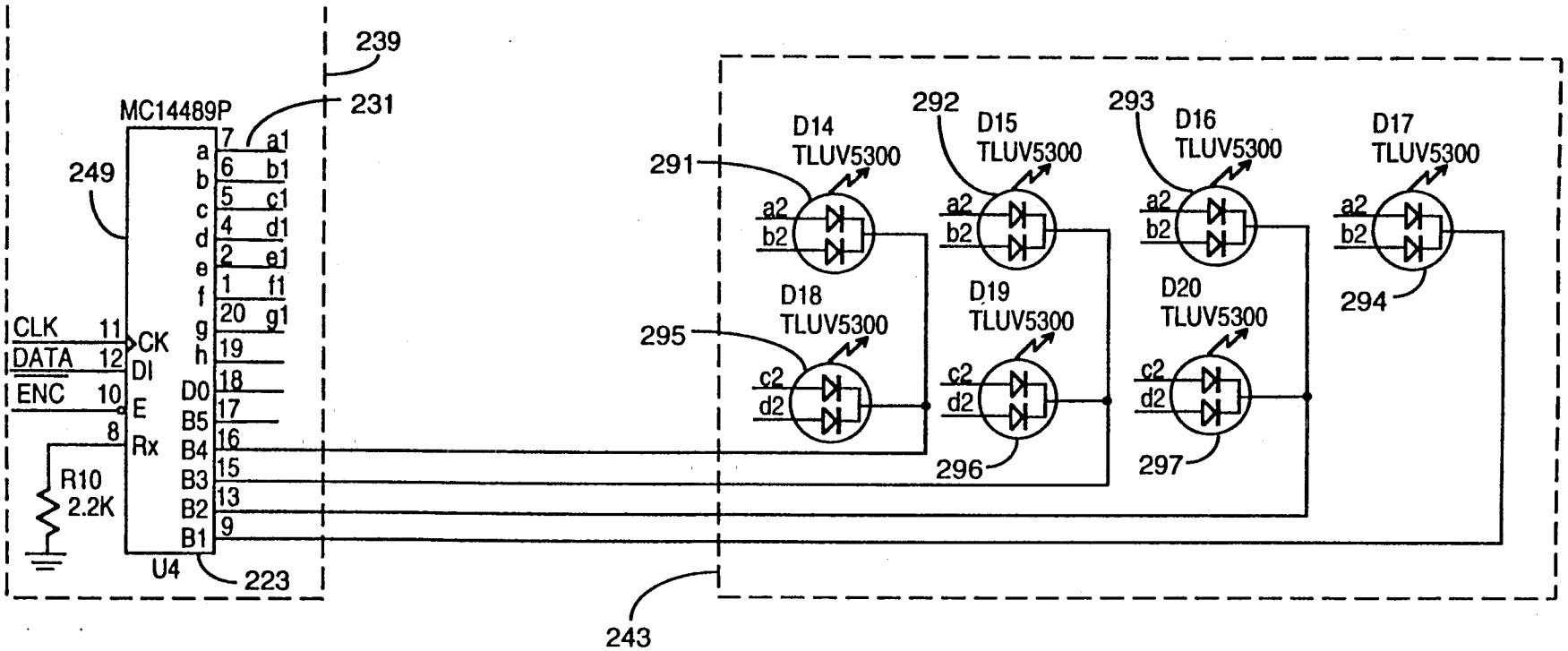

In one embodiment, the mark indicator lamps 41–47 and 51–57 are single bi-color LED's having the capability of indicating four different states. Referring to dart bed 32, for example, one color indicated on mark indicator lamp 41, e.g., green, may indicate that player one has scored one "20" mark, while another color, e.g., yellow (red and green together), may indicate a score of two "20" marks, and a third color, e.g., red, may indicate a score of three "20" marks. The fourth state, with the lamp 41 deactivated, indicates that no "20" marks have been scored. Additional detail with regard to using bi-color LED's for the mark indicator lamps 41–47 and 51–57 is shown in FIG. 3.

Figure 4A:
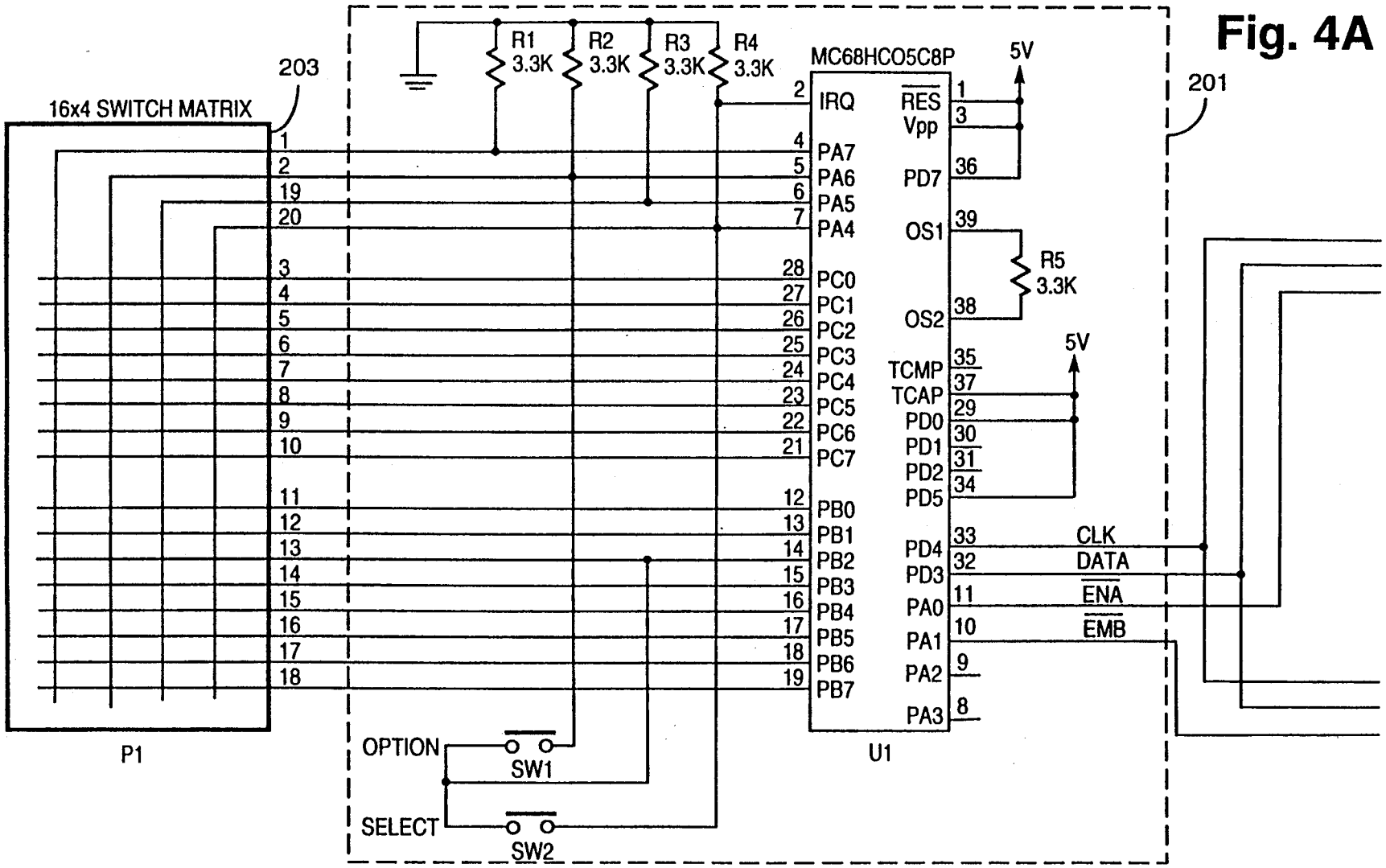
FIGS. 4A and 4B together (collectively referred to herein as FIG. 4) are a circuit diagram illustrating another embodiment of the present invention wherein flashing LED I s are used to indicate a current score.
Figure 4B:
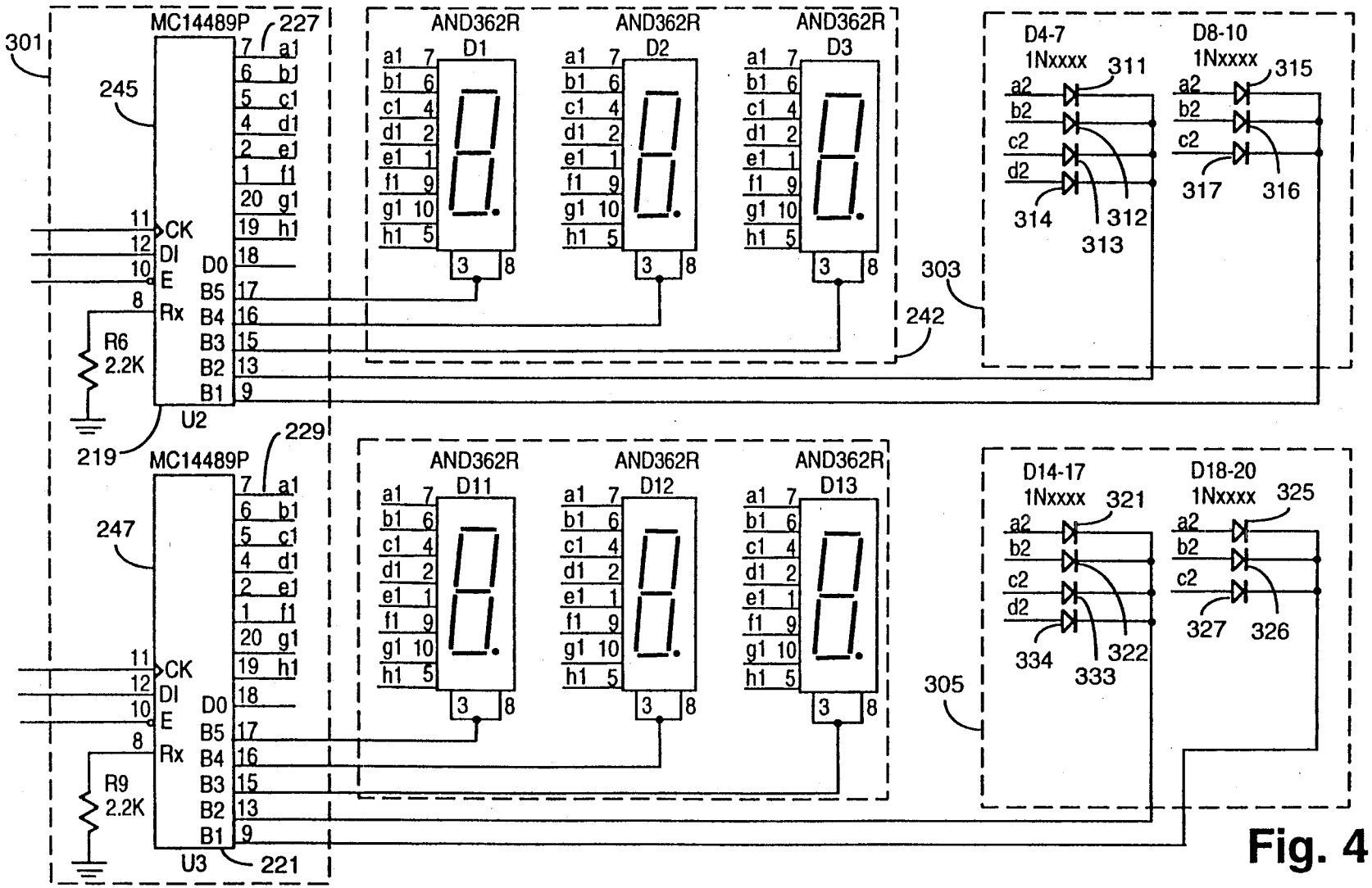

In another embodiment, mark indicator lamps 41–47 and 51–57 flash at different rates to indicate different states of marking. For example, a slow flashing rate may indicate one mark, a faster rate may indicate two marks, a continuously activated lamp may indicate three marks, and a deactivated lamp may indicate no marks. Additional detail with regard to using flashing LED's for the mark indicator lamps 41–47 and 51–57 is illustrated in FIG. 4.

In a still further embodiment, the above two embodiments may be combined to add flashing to the multi-colored lamps to accommodate those players who may be color blind. It should be understood that although the some of the embodiments of present invention utilize LED'S, any lamp device that may flash or use color filters or the like may also be used.

Besides causing the mark indicator lamps 41–47 and 51–57 to display the current mark score, the processing circuit 9 also causes the display driver circuit 13, via drive bus 15, to update numerical displays 17 and 21. Thus, the mark indicator lamps 41–47 and the numerical display 17 combine to represent the current score for player one. Similarly, the mark indicator lamps 51–57 and the numerical display 21 combine to represent the current score for player two.

In one embodiment, the numerical displays 17 and 21 are a series of seven segment LED's (actually eight segments but the "period" is not used) . The use of seven segment LED's is described in further detail below in reference to FIGS. 3 and 4. Although LED's are preferred, the numerical displays 17 and 21 may be LCD's (liquid crystal displays) , may be incorporated into the display on a CRT (cathode ray tube), or any other such display device.

As illustrated in FIG. 1, the score panel 5 is attached to the dart board 3, however the score panel 5 may be a separate unit. If separate, cabling (not shown) may connect the dart board 3 with the score panel 5 so that the score panel 5 might be located closer to the players. Furthermore, cabling is not required with if a keyboard (not shown) is added to the score panel 5, which would house the processing and display driver circuits 9 and 13. Instead of directly responding to dart impacts on the dart board 3, the processing circuit 9 would respond to manually indicated impacts entered through the keyboard by the players. This would provide ease of hand held or otherwise portable use of the score panel 5. Thus, the score panel 5 could be carried virtually anywhere and could be used to score games played on traditional cork dart boards.

Figure 2:
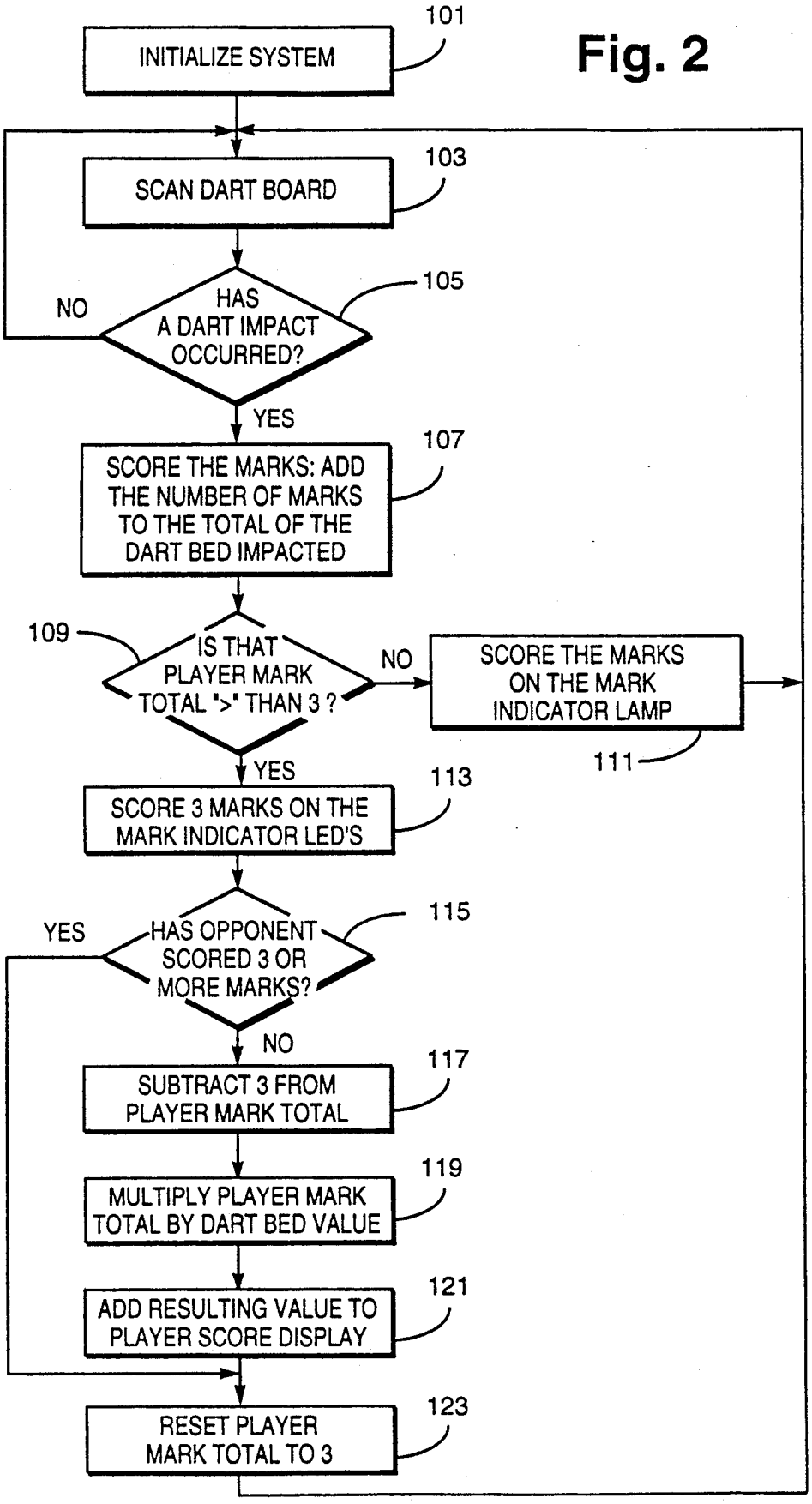
FIG. 2 is a flow chart illustrating an exemplary embodiment of the operation of the processing circuit of the present invention.

FIG. 2 represents a flow chart of the operation of the processing circuit 9 of FIG. 1. In block 101 of FIG. 2, the system or game is initialized by the processing circuit 9 to clear the numerical displays 17 and 21 as well as all mark indicator lamps 41–47 and 51–57. Next, at block 103, the processing circuit 9 scans the sensing bus 7 to determine whether a dart impact on the dart board 3 has occurred.

At block 105, the processing circuit 9 decides whether a dart impact has occurred in the dart beds 27–33. If not, the processing circuit 9 returns to block 103 to continue scanning. Upon determining at block 105 that an impact has occurred in one of the dart beds 27–33, the processing circuit 9 scores the marks by adding the number of marks to a player mark total for that particular dart bed, as shown in block 107. The processing circuit 9 maintains player mark totals for the players in internal memory (described below).

In block 109, the processing circuit 9 decides whether the player mark total is greater than three (3). If not, as shown in block ill, the processing circuit 9 directs the display driver circuit 13 to cause the player mark total for the impacted dart bed to be displayed on the corresponding mark indicator lamp. The processing circuit 9 then returns to continue scanning at block 103. If, at block 109, the player mark total is greater than three, the processing circuit 9 causes the display driver circuit 13 to score three marks on the corresponding mark indicator lamp of lamps 41–47 or 51–57 at block 113.

At block 115, the processing circuit 9 decides whether the player's opponent has scored three or more marks in the dart bed 27–33 impacted. If the opponent has scored three or more marks in that bed, the processing circuit 9 resets the player mark total to three at block 123 and returns to block 103 to continue scanning. If the opponent has not scored three or more such marks, the processing circuit 9 subtracts three from the player mark total at block 117, multiplies the resulting player mark total by the dart bed 27–33 value at block 119, and causes the display driver circuit 13 at block 121 to add the resulting value to the appropriate player numerical display 17 or 21.

Thereafter, the processing circuit 9 resets the player mark total to 3 at block 123 and returns to block 103 to repeat the process.

The flow chart illustrated in FIG. 2 is an exemplary embodiment of the present invention. It would be obvious to one skilled in the art to carry out the operation of the processing circuit 9 of FIG. 1 in a variety of other ways.

FIG. 3 illustrates an embodiment of the present invention wherein multi-color LED's are used for the mark indicator lamps 41–47 and 51–57 of FIG. 1. Block 201 represents the processing circuit 9 (FIG. 1) which includes a control processor 205, having on-board memory. Although other CPU's (central processing units) are contemplated, the control processor used is produced by Motorola, Inc, model number MC68HC05C8P.

Upon initialization of the system, the control processor 205 causes the score display 5 (FIG. 1) to be reset, and monitors a select switch 209 and an option switch 207 for selection of both the dart game to be played (Cricket, 301, 501, etc.) and the number of players. Thereafter, the control processor 205 monitors a switch matrix 203 that is associated with the dart segments of the dart board 3 (FIG. 1) so that a dart impact can be detected. The switch matrix 203 may be a 16×4 matrix as shown in FIG. 3 or may be some other matrix, as, for example, an 11×8. Upon each impact, the control processor 205 calculates the current score and causes the score display 5 (FIG. 1) to be updated if necessary.

Specifically, the control processor 205 initializes the system by clearing the bi-color LED's 281–287 and 291–297 found in blocks 241 and 243, as well as the three digit numerical displays 246 and 248 found in blocks 242 and 244.

Once the game of Cricket and number of players is selected via the switches 207 and 209, the control processor 205 begins scanning the matrix switch 203 for indications of dart impacts. Particularly, the control processor 205 scans input lines 235, labeled PA4–PA7, while sequentially driving the output lines 217 and 225, respectively labeled PB0–PB7 and PC0–PC7, to an active high (near +5V) level to determine whether a switch in the matrix has been depressed.

A depression of a switch in the matrix 203 completes a pathway to ground through one of a series of pull-down resistors 211–214, causing a logic high level to be detected at a corresponding one of the input lines 235. Because the inputs 235 are normally pulled to a logic low level by pull-down resistors 211–214, the control processor 205 can identify whether or not any dart impact has occurred. In addition, because the specific input and output lines in the scanned pathway are known, the control processor can also identify the specific segment of the dart board 3 (FIG. 1) which has been impacted. The control processor 205 then determines the number of marks that the specific dart impact represents then adds that number to the player's mark total (stored in on-board memory) for that particular dart bed 27–33.

If the player's mark total is not greater than three (3), the control processor 205 causes the display driver circuit illustrated in block 239, to light the appropriate bi-color LED 281–287 (in block 241) or 291–297 (in block 243) if player one or two is throwing, respectively. For example, one mark scored may be represented by lighting one color, e.g., red, of the LED while two marks scored may be represented by lighting the other color, e.g., green, of the LED. Three marks scored may be represented by lighting both colors of the LED, i.e., red and green to make yellow. After the dart impact is scored, the control processor 205 returns to the scanning of the switch matrix 203 to identify another dart impact.

If, however, the player's mark total is greater than three, the control processor 205 causes the display driver circuit illustrated in block 239 to indicate that three marks have been scored. As explained above, this may be achieved by lighting both colors of one of the appropriate bi-color LED's 281–287 and 291–297 depending on the particular dart bed 27–33 impacted and on which player is throwing. The control processor 205 then checks its internal memory to determine whether the player's opponent has scored three or more marks in the same one of dart beds 27–33. If the opponent has scored three or more marks in that particular dart bed, the control processor 205 resets the player's mark total to 3, and returns to the scanning of the switch matrix 203 to identify another dart impact. If instead the opponent has not scored 3 or more marks, the control processor subtracts three from the player's mark total, multiplies the player's mark total by the associated dart bed number, and causes the display driver circuit illustrated in block 239 to add the resulting value to one of numerical displays 246 and 248 depending on which player is throwing. The control processor 205 then returns to the scanning of the switch matrix 203 to identify another dart impact.

The control processor 205 continues this process until the game has ended.

Block 239 illustrates an embodiment of the display driver circuitry 13 of FIG. 1, and includes display drivers 245, 247, and 249. The display drivers shown, MC14489P, are produced by Motorola, Inc. The display driver 245 includes driver path lines 219, labeled B1–B5, as well as display drive lines 227, labeled a1, b1, c1, d1, e1, f1, g1, and h1. The display driver 247 includes driver path lines 221, labeled B1 through B5, as well as display drive lines 229, labeled a2, b2, c2, d2, e2, f2, g2, and h2. Similarly, the display chip 249 includes driver path lines 223, labeled B1 through B5, as well as display lines 231, labeled a3, b3, c3, and d3.

A clock output 251, data output 253, and enable outputs 255, 257, and 259, of the control processor 205 allow data from the control processor 205 to be clocked into any one of the display drivers 245, 247, or 249 depending on the logic levels of the enable output 255, 257, or 259 chosen by the control processor 205. For example, if a logic low level is placed on enable output 255, the display driver 245 is chosen.

Blocks 242 and 244 of FIG. 3 illustrate an embodiment of the numerical displays 17 and 21 of FIG. 1. Block 242 includes seven segment numerical display LED's 261, 263, and 265 corresponding to player 1's numerical score. Similarly, block 244 includes seven segment numerical display LED's 267, 269, and 271 corresponding to player 2's numerical score. The score display LED's 261, 263, 265, 267, 269, and 271 shown, AND362R, are produced by AND.

Blocks 241 and 243 illustrate an embodiment of the mark indicator lamps 41–47 and 51–57 of FIG. 1 wherein bi-color LED's are used. The mark indicator LED's 281–287 and 291–297 may be model LN11WP38 produced by Panasonic.

The display drivers 245, 247 and 249 control the numerical display LED's 261, 263, 267, 269, and 271 as well as mark indicator LED's 281–287 and 291–297 via the driver path lines 219, 221, 223 and display drive lines 227, 229 and 231, respectively. Specifically, each of the display drivers establishes logic levels corresponding to a numerical value for a specific seven segment LED on its display drive lines, and enables a pathway through the selected seven segment LED so as to display the numerical value. Thereafter, each of the display drivers disable all pathways, establish logic levels on the display drive lines corresponding to another numerical value for another specific seven segment LED, and enable a pathway through the newly selected LED. By scanning in this way so as to sequentially establish pathways through all of the seven segment LED's, the entire numerical score can be displayed.

For example, to display a current numerical score of "020" on the numerical display 246, the display driver 219 places a logic level corresponding to the first 0" (of the "020" score) on the drive lines 227, and enables a path line labeled B3 of the driver path lines 219. By enabling the path line labeled B3, a current pathway is created causing the appropriate segments (corresponding to a "0") of the numerical display LED 265 to emit light. Next, the display driver 219 places a logic level corresponding to the "2" on the drive lines 227, and enables a path line labeled B4 of the driver path lines 219 creating a current pathway which causes the appropriate segments of the numerical display LED 265 to emit light. Similarly, using a path line labeled B5 of the driver path lines 219, the display driver 219 causes the most significant "0" of the score to be displayed.

The display driver 247 can similarly sequentially enable pathways to the mark indicator LED's 281–287 via the driver path lines 221 while establishing logic levels on the display drive lines 229 which correspond to desired color to be displayed.

The sequential scanning through the driver path lines is set at a rate greater than the decay time of the LED such that the light will appear constant. However, in another embodiment, the time period between each sequential pass through the driver path lines and the duration of each pathway can be adjusted so as to cause the bi-colored LED's to flash at different rates to indicate the current mark score.

FIG. 4 illustrates another embodiment of the present invention wherein flashing LED's are also used for mark indicator lamps 41–47 and 51–57 of FIG. 1. In FIG. 4, the functionality of the matrix switch 203 and the control processor illustrated in block 201 is identical to that described above in reference to FIG. 3 above. The differences, however, can be found in the display driver circuit and mark indicator LED's illustrated in blocks 301, 303 and 305.

The blocks 303 and 305 contain mark indicator LED's 311–317 and 321–327 which either flash at two different rates or are continually on or off, depending on the number of marks to be displayed. For example, turning a mark indicator LED off indicates no marks, whereas turning it on indicates three marks. Similarly, flashing at a lower rate indicates a single mark, whereas flashing at a higher rate indicates two marks. The display driver circuit illustrated in block 301 causes the different flashing rates or on or of f status as explained above in reference to FIG. 3. The LED's may be model LN21RPHL produced by Panasonic.

Figure 5:
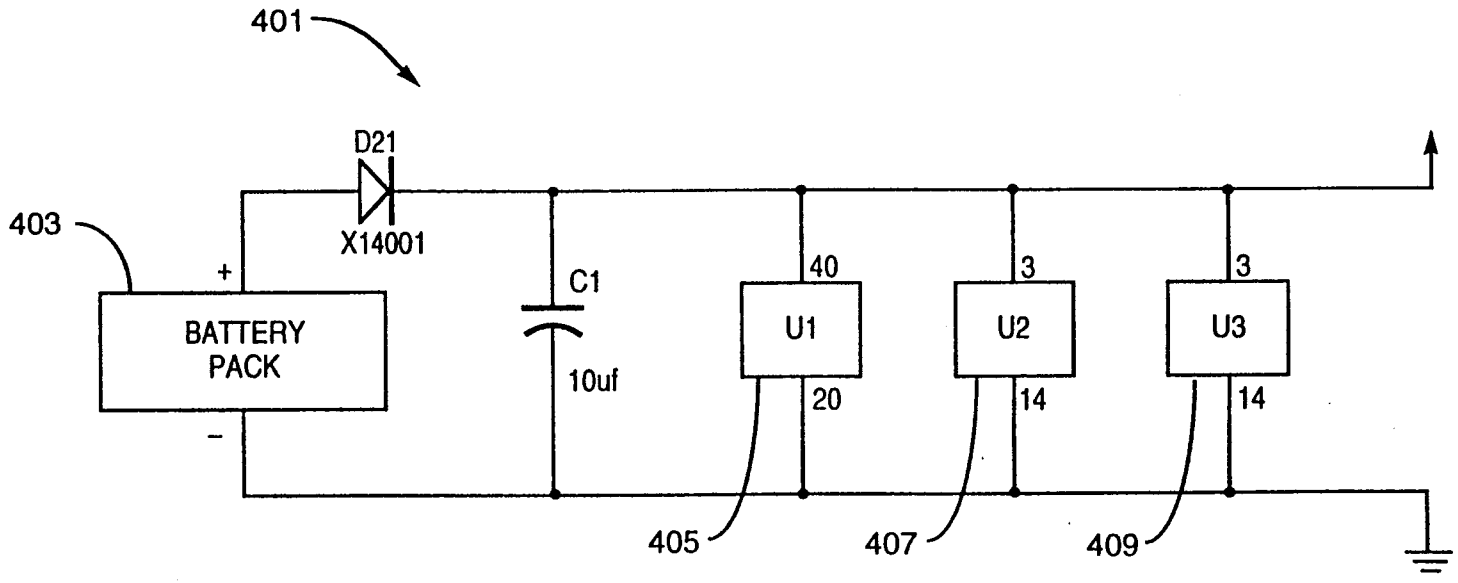
FIG. 5 is a circuit diagram illustrating the power source of the present invention.

FIG. 5 illustrates a power circuit 401 which is capable of powering the embodiments of the present invention found in FIGS. 3 and 4. The power circuit 401 includes a battery pack 403 which incorporates four regular "D" cell size batteries. The power circuit 401 further includes voltage regulators 405, 407, and 409 to stabilize the supply voltage at approximately +5V.

Many modifications and variations of the present invention are possible in light of the above teachings. Thus it is to be understood that, within the scope of the appended claims, the invention may be practiced otherwise than as described hereinabove.

We claim:

1. An electronic dart game having a plurality of dart beds and capable of scoring a game of Cricket, the electronic dart game comprising:

a plurality of switches for producing signals indicative of each dart thrown;

driver means for producing drive signals;

processing means responsive to the signals produced by the plurality of switches for calculating a current score, said processing means causing the driver means to produce drive signals indicative of the current score;

a score display responsive to the drive signals of the driver means for displaying the current score; and lamp means associated with the plurality of dart beds and responsive to the drive signals of the driver means for producing one of a plurality of colors of light indicative of the current score.

2. The electronic dart game of claim 1 further comprising means for causing the lamp means to flash so as to indicate the current score.

3. The electronic dart game of claim 1 wherein the control means includes a scanning means for scanning the plurality of switches to identify a dart impact.

4. The electronic dart game of claim 1 wherein the electronic dart game operates on battery power.

5. An electronic dart game having a plurality of dart beds and capable of scoring a game of Cricket, the electronic dart game comprising:

a plurality of switches for producing signals indicative of each dart thrown;

driver means for producing drive signals;

processing means responsive to the signals produced by the plurality of switches for calculating a current score, said processing means causing the driver means to produce drive signals indicative of the current score;

a score display which responds to the drive signals of the driver means by displaying the current score; and lamp means associated with the plurality of dart beds and responsive to the drive signals of the driver means for producing flashing light indicative of the current score.

6. The electronic dart game of claim 5 wherein said lamp means further provides means for producing one of a plurality of colors of light indicative of the current score.

7. The electronic dart game of claim 5 wherein the control means further comprising a scanning means for scanning the plurality of switches to identify a dart impact.

8. The electronic dart game of claim 5 wherein the electronic dart game operates on battery power.

9. An electronic dart game capable of scoring dart impacts in a game of Cricket, the electronic dart game comprising:

means for indicating dart impacts;

control means responsive to the indicating means for computing a current score, said control means producing drive signals indicative of the current score; and lamp means responsive to the drive signals of the control means for producing one of a plurality of colors of light indicative of the current score.

10. The electronic dart game of claim 9 wherein the lamp means is further responsive to the drive signals of the control means for producing flashing light so as to indicate the current score.

11. The electronic dart game of claim 9 wherein the indicating means further comprising a plurality of switches, and the control means further comprising means for monitoring the plurality of switches to identify the dart impact.

12. The electronic dart game of claim 9 further comprising a battery power circuit that powers the electronic dart game.

13. An electronic dart game capable of scoring dart impacts in a game of Cricket, the electronic dart game comprising:

means for indicating dart impacts;

control means responsive to the indicating means for computing a current score, said control means producing drive signals indicative of the current score; and lamp means responsive to the drive signals of the control means for producing flashing light indicative of the current score.

14. The electronic dart game of claim 13 wherein the lamp means is further responsive to the drive signals of the control means for producing one of a plurality of colors of light on the lamp means indicative of the current score.

15. The electronic dart game of claim 13 wherein the indicating means further comprising a plurality of switches, and the control means further comprising means for monitoring the plurality of switches to identify the dart impact.

16. The electronic dart game of claim 13 further comprising a battery power circuit that powers the electronic dart game.

* * * * *

UNITED STATES PATENT AND TRADEMARK OFFICE

CERTIFICATE OF CORRECTION

PATENT NO. : 5,318,319

DATED : June 7, 1994

INVENTOR(S) : Jones, et al.

It is certified that error appears in the above-indentified patent and that said Letters Patent is hereby corrected as shown below:

Column 4, line 4, delete "the".

Column 4, line 63, delete "ill" and insert -- 111 -- therefore.

Column 8, line 12, delete "of f" and insert -- off -- therefore.

Column 8, line 27, delete "We claim:" and insert -- In the claims: -- therefore.

Signed and Sealed this

Twenty-sixth Day of September, 1995

*Attest:*

Bruce Lehman

BRUCE LEHMAN

*Attesting Officer*

*Commissioner of Patents and Trademarks*